US011286747B2

(12) United States Patent
Tiwari et al.

(10) Patent No.: US 11,286,747 B2
(45) Date of Patent: Mar. 29, 2022

(54) SENSORED ELECTRONIC VALVE FOR DRILLING AND WORKOVER APPLICATIONS

(71) Applicant: Saudi Arabian Oil Company, Dhahran (SA)

(72) Inventors: Shrikant Tiwari, Dhahran (SA); Suliman Azzouni, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/987,391

(22) Filed: Aug. 6, 2020

(65) Prior Publication Data

US 2022/0042396 A1 Feb. 10, 2022

(51) Int. Cl.

| | |
|---|---|
| ***E21B 34/06*** | (2006.01) |
| ***E21B 34/16*** | (2006.01) |
| *E21B 47/06* | (2012.01) |
| *E21B 47/07* | (2012.01) |
| *E21B 47/12* | (2012.01) |

(52) U.S. Cl.

CPC ..... *E21B 34/066* (2013.01); *E21B 34/16* (2013.01); *E21B 47/06* (2013.01); *E21B 47/07* (2020.05); *E21B 47/12* (2013.01); *E21B 2200/05* (2020.05)

(58) Field of Classification Search

CPC ..... E21B 34/066; E21B 34/16; E21B 47/07; E21B 47/12; E21B 47/06; E21B 2200/05; E21B 2200/04

See application file for complete search history.

(56) References Cited

U.S. PATENT DOCUMENTS

| | | | |
|---|---|---|---|
| 4,706,933 | A | 11/1987 | Sukup et al. |
| 5,310,005 | A | 5/1994 | Dollison |
| 6,125,930 | A | 10/2000 | Moyes |
| 6,450,258 | B2 | 9/2002 | Green et al. |

(Continued)

FOREIGN PATENT DOCUMENTS

| | | | |
|---|---|---|---|
| GB | 2443374 | A | 4/2008 |
| GB | 2444194 | A | 5/2008 |

(Continued)

OTHER PUBLICATIONS

International Search Report and Written Opinion for PCT Application No. PCT/US2021/044823 dated Oct. 21, 2021.

*Primary Examiner* — Michael R Wills, III
(74) *Attorney, Agent, or Firm* — Bracewell LLP; Constance G. Rhebergen; Linda L. Morgan

(57) ABSTRACT

Systems and methods for controlling a flow of fluid within a subterranean well includes a sensored electronic valve assembly having a one way valve member operable to allow a flow of fluids in a first direction through the one way valve member and to prevent the flow of fluids in a second direction through the one way valve member. An electronic circuit includes a battery having a battery life of a predetermined time and a command center. A sensor can detect a valve open signal and to deliver the valve open signal to the command center. An opening device is operable to move the one way valve member to a valve open position upon receipt of an engagement signal from the command center. The opening device is inoperable after the predetermined time. The one way valve member is operable to function as a one way valve after the predetermined time.

17 Claims, 2 Drawing Sheets

(56) References Cited

U.S. PATENT DOCUMENTS

| | | | | |
|---|---|---|---|---|
| 6,666,271 | B2 | 12/2003 | Deaton et al. | |
| 6,684,950 | B2 | 2/2004 | Patel | |
| 6,926,089 | B2 | 8/2005 | Goodson, Jr. et al. | |
| 7,086,481 | B2 | 8/2006 | Hosie et al. | |
| 7,252,152 | B2 | 8/2007 | Logiudice et al. | |
| 7,789,156 | B2 | 9/2010 | Pia | |
| 8,464,799 | B2 | 6/2013 | Scott et al. | |
| 9,163,479 | B2 | 10/2015 | Rogers et al. | |
| 10,088,064 | B2 | 10/2018 | Churchill | |
| 2005/0230118 | A1 | 10/2005 | Noske et al. | |
| 2008/0053662 | A1* | 3/2008 | Williamson | E21B 34/066 166/381 |
| 2012/0067594 | A1* | 3/2012 | Noske | E21B 34/08 166/373 |
| 2013/0048290 | A1 | 2/2013 | Howell et al. | |
| 2013/0206389 | A1* | 8/2013 | Vick, Jr. | E21B 34/101 166/105 |
| 2014/0202768 | A1* | 7/2014 | Noske | E21B 34/14 175/57 |
| 2016/0177673 | A1 | 6/2016 | Merron et al. | |
| 2017/0218722 | A1* | 8/2017 | Gordon | E21B 33/134 |
| 2017/0247960 | A1* | 8/2017 | Kyle | E21B 34/066 |
| 2017/0248009 | A1* | 8/2017 | Fripp | E21B 33/10 |
| 2019/0128098 | A1 | 5/2019 | Ross et al. | |
| 2020/0141211 | A1* | 5/2020 | Franklin | E21B 34/14 |
| 2020/0141506 | A1* | 5/2020 | Holder | F16K 17/30 |
| 2020/0347699 | A1* | 11/2020 | Coates | E21B 34/16 |

FOREIGN PATENT DOCUMENTS

| | | | |
|---|---|---|---|
| WO | 2013006159 | A1 | 10/2013 |
| WO | 2019112579 | A1 | 6/2019 |

* cited by examiner

SENSORED ELECTRONIC VALVE FOR DRILLING AND WORKOVER APPLICATIONS

BACKGROUND OF THE DISCLOSURE

1. Field of the Disclosure

The present disclosure relates to subterranean well development, and more specifically, the disclosure relates to valves used within tubular members and non-tubular members of subterranean wells.

2. Description of the Related Art

Several types of valves are used in downhole drilling or completion assemblies in hydrocarbon wells. These valves allow fluid flow or stop fluid flow either in one or both directions, as required for the application and objectives of the operation. The valves in some cases compartmentalizes the well bore in order to create specialized treatments for different sections of a wellbore Drilling and completion operations in hydrocarbon wells require several downhole equipment assemblies. Downhole valves are important parts of certain downhole equipment assemblies. Commonly used downhole valves include float valves, spring loaded check valves, flapper valves, ball valves, drop in check valves, and multi-activation circulating valves. In fracking or stimulation operations ball seats with different size balls are used to stop fluid flow in certain direction and to direct fluid to a certain part of the well bore. These downhole valves are used in different circumstances to meet safety and operational objectives of subterranean wells. Other devices, which are also used downhole for providing fluid flow isolation include ceramic discs or mechanically controlled inflow valves. These devices act as permanent installations in the tubular string and allow the flow of fluid only when either broken or shifted open through an intervention tool.

SUMMARY OF THE DISCLOSURE

Systems and methods of this disclosure provide a sensored electronic valve that allows the flexibility to open and close the valve member by activating a sensor as, and when, the flow of fluid or equipment access through the valve member is required. The opening and closing of the valve member can be accomplished using a battery powered closed loop electronic system. Embodiments of this disclosure provide systems and methods that allow for safe and stable conditions downhole with a one way valve, while including the ability to override the normal functioning of the valve when there is an operational need. This valve design can be used for a variety of applications related to the control of fluid flows in the wellbore. The sensored electronic valve can convert to traditional functioning one way valve after the intervention requirements have been completed.

In an embodiment of this disclosure a system for controlling a flow of fluid within a subterranean well with a sensored electronic valve assembly is disclosed. The system includes the sensored electronic valve assembly having a one way valve member operable to allow a flow of fluids in a first direction through the one way valve member and to prevent the flow of fluids in a second direction through the one way valve member. An electronic circuit includes a battery and a command center, the battery having a battery life of a predetermined time. A sensor is operable to detect a valve open signal and to deliver the valve open signal to the command center. An opening device is operable to move the one way valve member to a valve open position upon receipt of an engagement signal from the command center. The opening device is inoperable after the predetermined time. The one way valve member is operable to function as a one way valve after the predetermined time. Alternatively, a solenoid can be used which generates electric current as a magnetized chip pass through it. The electric current will activate the command center to operate the flapper valve.

In alternate embodiments, the sensored electronic valve assembly can be part of a completion system and located within a tubular string. The valve member can be removable. The command center can include a data processor and a signal transmitter. The opening device can be a motor. Alternately, the opening device can be an electromagnet.

In other alternate embodiments, the valve open signal can be a proximity of an intervention tool. The one way valve member can be a normal closed valve and the sensor can be further operable to detect a valve open signal and to deliver the valve open signal to the command center. The opening device can be operable to disengage the one way valve member to allow the one way valve member to return to a normal closed position upon receipt of a disengagement signal from the command center.

In an alternate embodiment of this disclosure, a system for controlling a flow of fluid within a subterranean well includes a sensored electronic valve assembly. The system further includes a tubular string extending into the subterranean well, the tubular string having an internal bore for transportation of fluid between an earth's surface and a downhole location within the subterranean well. The sensored electronic valve assembly is located along the tubular string. The sensored electronic valve assembly has a one way valve member operable to allow a flow of fluids within the tubular string in a first direction through the one way valve member and to prevent the flow of fluids within the tubular string in a second direction through the one way valve member. A battery has a battery life of a predetermined time. A sensor is operable to detect a valve open signal. An opening device is operable to move the one way valve member to a valve open position after receipt of the valve open signal by the sensor. The opening device is inoperable after the predetermined time. The one way valve member is operable to function as a one way valve after the predetermined time.

In alternate embodiments, the system can further include a command center and the command center can be operable to receive the valve open signal detected by the sensor and to deliver an engagement signal to the opening device. The sensored electronic valve assembly can further include a valve body, the valve body housing the one way valve member and being secured in-line along the tubular string.

In another alternate embodiment of this disclosure, a method for controlling a flow of fluid within a subterranean well with a sensored electronic valve assembly includes delivering the sensored electronic valve assembly into the subterranean well. The sensored electronic valve assembly has a one way valve member operable to allow a flow of fluids in a first direction through the one way valve member and to prevent the flow of fluids in a second direction through the one way valve member. An electronic circuit includes a battery and a command center. The battery has a battery life of a predetermined time. The sensored electronic valve assembly further includes a sensor and an opening device. The opening device is inoperable after the predetermined time. The one way valve member is operable to function as a one way valve after the predetermined time. The method further includes delivering a valve open signal into the subterranean well. The valve open signal is received by the sensor and is delivered to the command center by the sensor. An engagement signal is delivered from the command center to the opening device, causing the opening device to move the one way valve member to a valve open position.

In alternate embodiments, delivering the sensored electronic valve assembly into the subterranean well can include delivering the sensored electronic valve assembly into the subterranean well within a tubular string as part of a completion system. The method can further include removing the valve member from the subterranean well while the tubular string remains within the subterranean well. The command center can include a data processor and a signal transmitter and the method can further include processing the valve open signal with the data processor and delivering the engagement signal from the command center to the opening device with the signal transmitter.

In other alternate embodiments, the opening device can be a motor and the method can further include moving the one way valve member to the valve open position and retaining the one way valve member in the valve open position with the motor. Alternately, the opening device can be an electromagnet and the method can further include moving the one way valve member to the valve open position and retaining the one way valve member in the valve open position with the electromagnet.

In yet other alternate embodiments, delivering the valve open signal into the subterranean well can include moving an intervention tool proximate to the sensored electronic valve assembly. The one way valve member can be a normal closed valve and the method can further include detecting a valve close signal with the sensor and delivering the valve close signal to the command center. The opening device can be operable to disengage the one way valve member to allow the one way valve member to return to a normal closed position upon receipt of a disengagement signal from the command center.

BRIEF DESCRIPTION OF THE DRAWINGS

So that the manner in which the features, aspects and advantages of the embodiments of this disclosure, as well as others that will become apparent, are attained and can be understood in detail, a more particular description of the disclosure may be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

As used in this Specification, the term "substantially equal" means that the values being referenced have a difference of no more than two percent of the larger of the values being referenced.

Where reference is made in the specification and appended Claims to a method comprising two or more defined steps, the defined steps can be carried out in any order or simultaneously except where the context excludes that possibility.

Figure 1:
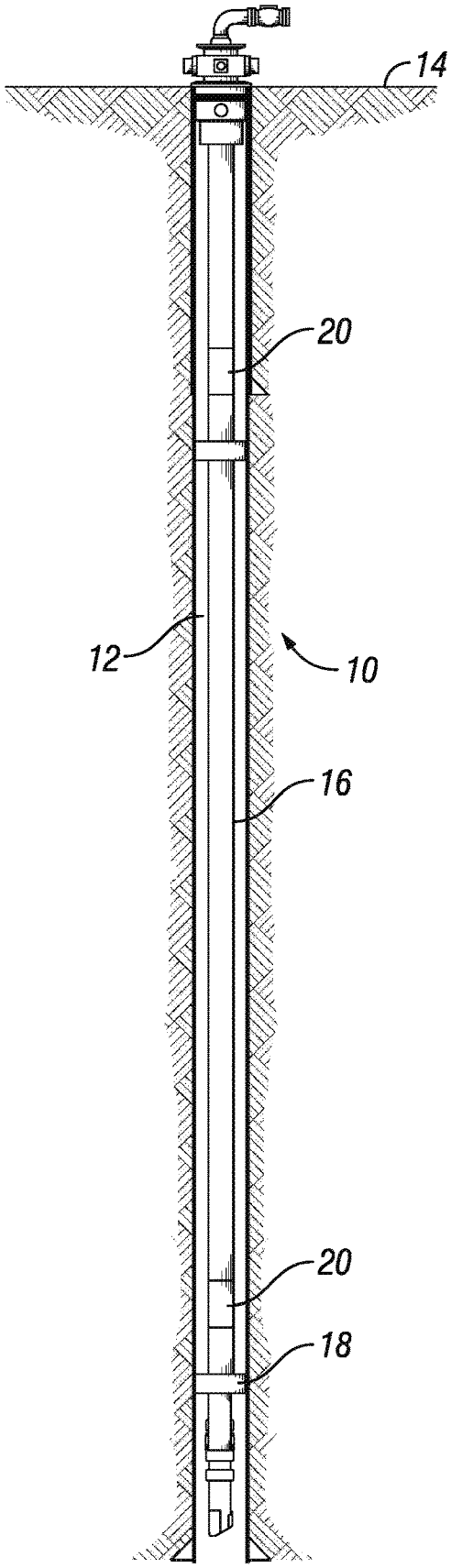
FIG. 1 is a schematic section view of a subterranean well with a sensored electronic valve, in accordance with an embodiment of this disclosure.

Looking at FIG. 1, subterranean well 10 can have wellbore 12 that extends to an earth's surface 14. Subterranean well 10 can be an offshore well or a land based well and can be used for producing hydrocarbons or other fluids from subterranean hydrocarbon reservoirs. Wellbore 12 can be drilled from surface 14 and into and through various subterranean formations. In the example of FIG. 1, wellbore 12 extends generally vertically relative to the earth's surface 14. In alternate embodiments, at least a portion of wellbore 12 can be a horizontal well that extends generally horizontally relative to the earth's surface 14, or can be an inclined well that extends at another angle relative to earth's surface 14.

A tubular string 16, such as a completion, multi stage fracturing assembly, or production string can be used to deliver the fluids from the hydrocarbon reservoir to the surface. Tubular string 16 can be formed of a series of tubular pipe joints that are secured end to end. Tubular string 16 can have an internal bore for the transportation of fluid between earth's surface 14 and a downhole location within subterranean well 10. Tubular string 16 can include a lower isolation assembly 18. Lower isolation assembly 18 can engage an inner diameter surface of wellbore 12 so that lower isolation assembly 18 seals the space between tubular string 16 and wellbore 12. Tubular string 16 can include additional isolation assemblies along the length of tubular string 16.

Tubular string 16 can further include one or more sensored electronic valve assemblies 20. Sensored electronic valve assembly 20 is secured in-line with adjacent tubular pipe joints of tubular string 16. As an example, sensored electronic valve assembly 20 can be threaded to adjacent tubular pipe joints to form tubular string 16. Sensored electronic valve assembly 20 can be used to control the flow of fluid within subterranean well 10. In particular, sensored electronic valve assembly 20 can be used to control the flow of fluid within tubular string 16. In the example embodiment of FIG. 1, sensored electronic valve assembly 20 is part of a completion system and located along a production tubular. In alternate embodiments, sensored electronic valve assembly 20 can be part of a drilling string or an alternate type of tubular string that is utilized within a subterranean well.

Figure 2:
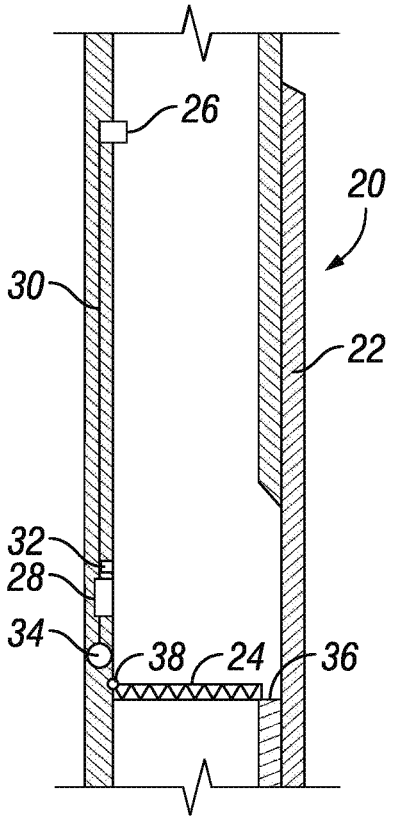
FIG. 2 is a schematic section view of a sensored electronic valve, in accordance with an embodiment of this disclosure, with the sensored electronic valve shown in a closed position.
Figure 3:
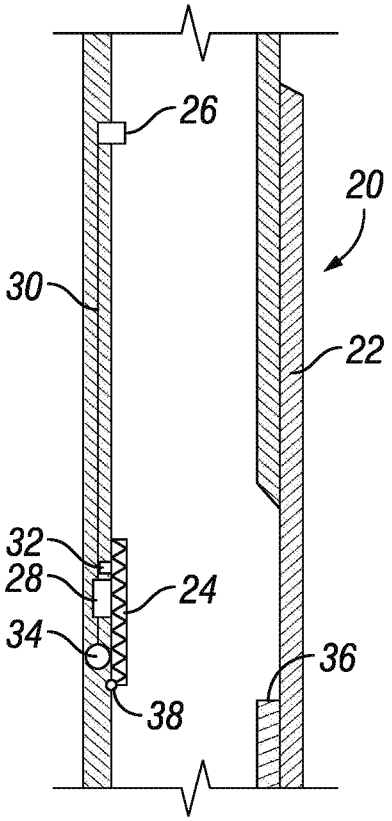
FIG. 3 is a schematic section view of a sensored electronic valve, in accordance with an embodiment of this disclosure, with the sensored electronic valve shown in an open position.

Looking at FIGS. 2-3, sensored electronic valve assembly 20 includes valve body 22, which is a generally elongated tubular member. Valve body 22 is secured in-line along tubular string 16. Valve body 22 houses the other components of sensored electronic valve assembly 20.

Sensored electronic valve assembly 20 includes one way valve member 24. In the example embodiments, one way valve member 24 is shown as a flapper valve. In alternate embodiments, one way valve member 24 can be a ball valve, a spring loaded valve, or an alternate type of valve that allows for a flow of fluid in one direction. Although embodiments of this disclosure include the example of a one way valve member, other embodiments could alternately include a two way valve which can perform the same functions as the one way valve member described in this disclosure.

As shown in the example embodiments, one way valve member 24 will allow for a flow of fluid in an uphole direction through sensored electronic valve assembly 20, and can prevent the flow of fluid in a downhole direction through sensored electronic valve assembly 20.

There may be times when it is desirable for one way valve member 24 to allow for the passage of fluid, tools, or other equipment to move through sensored electronic valve assembly 20 in both directions. In such a case, one way valve member 24 can be moved and maintained in an open position by operator instruction, as shown in FIG. 3.

Sensor 26 can be used to detect a valve open signal. Sensor 26 can be located uphole of one way valve member 24. In alternate embodiments, sensor 26 can be located downhole of one way valve member 24 or at the elevation of one way valve member 24. The location of sensor 26 will be dependent on the type of sensor used and the method of providing the valve open signal to sensor 26.

Sensor 26 can be triggered, as an example, by a metallic intervention tool, a tubular member, a cable, a wireline, an e-line, a slick line, or a digital slick line that moves proximate to or past sensor 26 in a downhole direction. Even a partial break or obstruction of the sensors by such a trigger can be interpreted as a valve open signal. In alternate embodiments, sensor 26 can detect a radio frequency identification signal, a magnetic signal, an acoustic signal, a specific flowrate or a specific change in flow rate, a specific pressure or a change in pressure, or a specific temperature or a change in temperature signature as the valve open signal.

As a further example, sensor 26 can be a magnetic sensor that is triggered with a series of magnetic signatures. These magnetic values can be installed in a form of magnetized pipes that would trigger the sensor if read in the correct sequence during the running of the magnetized pipe into the wellbore and if needed, at a pre-determined speed. Alternately, sensor 26 can be a radio frequency identification sensor that is triggered by a pipe containing a radio frequency identification tag. In such examples, the triggering of the sensor is the receipt by the sensor of a valve open signal.

Sensor 26 can communicate to command center 28 that a valve open signal has been received. Sensor 26 can communicate with command center 28 by way of communication wire 30 that runs through a sidewall of valve body 22.

Command center 28 and sensor 26 can be powered by battery 32. Command center 28 and battery 32 can be part of an electronic circuit that can control the operation of one way valve member 24. In embodiments, the electronic circuit can be a smart activating circuit that can be triggered to change the behavior of the valve in terms of timing and pressure holding value. This smart circuit can send information on diagnostics as an example as well as other information including but not limited to battery life and pressure information.

The characteristics of battery 32 will be selected to suit wellbore temperature, wellbore pressure, and the desired battery life. Battery 32 can have a battery life of a predetermined length of time. The battery life of battery 32 can be sufficiently long to enable the electronic circuit to operate one way valve member 24 until the expected well interventions are completed. After the predetermined time has expired and the battery life is over, the electronic circuit will stop working and sensored electronic valve assembly 20 can function as a one way valve, allowing only unidirectional flow through sensored electronic valve assembly 20 without the ability for any further intervention.

In alternate embodiments, a battery charging feature can be included to charge battery 32 downhole using induction. As an example, the induction can be initiated with a magnetic current resulting from magnets that are run into wellbore 12 using an electronic tool. The battery charging feature may be required, for example, if battery 32 is not capable of remaining charged for the predetermined time, or if additional time is required to complete the well intervention operations. In other alternate embodiments, a solenoid can be used which generates electric current as a magnetized chip passes through it. The electric current can activate command center 28 to operate the valve member.

Sensored electronic valve assembly 20 further includes opening device 34. Opening device 34 can be, for example, a motor, an electromagnet, or another device that is capable of moving one way valve member 24 from the closed position of FIG. 2 to the open position of FIG. 3, and maintaining one way valve member 24 in the open position. However, after the predetermined time has expired and battery 32 no longer has a charge opening device 34 will be inoperable.

After command center 28 receives the signal from sensor 26 that a valve open signal has been received, a data processor can process the signal from sensor 26. The command center can then transmit an engagement signal to opening device 34 from a signal transmitter of the command center. Opening device 34 will move one way valve member 24 to the open position and retain one way valve member 24 in the open position after receipt of the engagement signal. As an example, the engagement signal may be the delivery of power to opening device 34 so that opening device 34 can operate to move and retain one way valve member 24 in the open position.

If, for example, opening device 34 is a motor, then one way valve member 24 can be moved from the closed position of FIG. 2 to the open position of FIG. 3 with the motor. The motor can further retain one way valve member 24 in the open position. Alternately, if opening device 34 is an electromagnet, then one way valve member 24 can be moved from the closed position of FIG. 2 to the open position of FIG. 3 with the electromagnet. The electromagnet can be designed to exert enough pull force on one way valve member 24 to pull one way valve member 24 to the open position. The electromagnet can further retain one way valve member 24 in the open position.

One way valve member 24 can be a normal closed valve. In that way, if opening device 34 is not retaining one way valve member 24 in the open position, then one way valve member 24 will return to the normal closed position. Looking at FIG. 2, in the normal closed position, one way valve member 24, which is a flapper, is resting on valve stop 36. Valve stop 36 protrudes radially inward from the sidewall of valve body 22. The flapper is held in place resting on valve stop 36 by a biasing member 38. Biasing member 38 can be, for example, a spring. The valve member 24 rests on stop 36 such that it provides a seal and disallows any movement of fluid in the blocked direction.

When opening device 34 receives a disengagement signal from command center 28, opening device 34 will cease holding one way valve member 24 in the open position of FIG. 3 and biasing member 38 will return one way valve member 24 to the normal closed position.

Command center 28 will deliver the disengagement signal to opening device 34 when sensor 26 received a valve closed signal. The valve close signal can be, as an example, a metallic intervention tool, a tubular member, a cable, a wireline, an e-line, a slick line, or a digital slick line that moves away from or past sensor 26 in an uphole direction. In alternate embodiments, sensor 26 can detect a radio frequency identification signal, a magnetic signal, an acoustic signal, a specific flowrate or a specific change in flow rate, a specific pressure or a change in pressure, or a specific temperature or a change in temperature signature as the valve close signal.

As a one way valve, one way valve member 24 can also be moved to the open position, or at least be moved off of valve stop 36 and into a position somewhere between fully closed and fully open, by a flow of fluid in an uphole direction. The flow of fluid in the uphole direction would be required to exert a sufficient amount of force on one way valve member 24 to overcome the force of biasing member 38. After the predetermined time has expired and battery 32 no longer has a charge, opening device 34 will be inoperable and one way valve member 24 can continue to function as a traditional one way valve.

In certain embodiments it may be beneficial to further remove one way valve member 24 from subterranean well 10 after the predetermined time has expired and battery 32 no longer has a charge. In such embodiments, one way valve member 24 can be removed from subterranean well 10 while tubular string 16 remains within subterranean well 10. In such embodiments, one way valve member 24 can be destroyed in place. As an example, one way valve member 24 can be designed to be broken into piece, such as through the use of a breaking tool, coil tubing, or an increased pressure. Alternately, one way valve member 24 can be formed of a material that dissolves over time. In other alternate embodiments, one way valve member 24 can be formed of a material that will dissolve with the delivery of a pre-designed chemical through the bore of tubular string 16.

In an example of operation, in order to control the flow of fluid within subterranean well 10, sensored electronic valve assembly 20 can be delivered into subterranean well 10 as part of a tubular string, such as being part of tubular string 16. One way valve member 24 can be in an open position while tubular string 16 is run into wellbore 12, allowing a flow of fluid through tubular string 16 in an uphole direction. After the tubular string with sensored electronic valve assembly 20 has reached a desired depth within wellbore 12, one way valve member 24 will be moved to the normal closed position by biasing member 38.

A valve open signal can be delivered to sensor 26. As an example, as the intervention tool or coil tubing for pumping stimulation fluid is run inside a multistage fracturing assembly, sensor 26 will detect the tubing or the intervention tool and interpret as a valve open signal. The valve open signal, having been received by the sensor 26, is delivered to command center 28 by sensor 26. Command center 28 can then deliver an engagement signal to opening device, 34, causing opening device 34 to move one way valve member 24 to the valve open position, and maintain one way valve member 24 in the open position.

After the intervention operation is complete, the intervention tool or coil tubing is pulled above sensor 26. Sensor 26 can interpret the movement of the intervention tool or coil tubing in a direction uphole as a valve close signal. Sensor 26 can deliver the valve close signal to command center 28. Command center 28 will in turn deliver a disengagement signal to opening device 34. Because one way valve member 24 is a normal closed valve, one way valve member can then return to the normal closed position.

In a further example of operation, sensored electronic valve assembly 20 can be used as part of a multi stage fracking and acid stimulation operation. The process of multi stage fracking begins with running a multi stage fracking assembly into the wellbore with packers spaced out along the multistage fracking assembly to isolate several segments of the reservoir. Acid stimulation or fracking is carried out selectively for each isolated reservoir segment one at a time.

A commonly used arrangement is to selectively open the port across selected reservoir segment for pumping stimulation fluid at pre-designed rate and pressure. In some currently available systems and methods, as soon as stimulation fluid is injected, the wellbore starts to lose fluid into the formation. The cumulative losses after several stages of stimulation could create underbalance conditions in the well due to a loss of hydrostatic head. Stabilizing the well requires considerable time before other operations can be safely carried out following Industry standard well control standards.

By including a sensored electronic valve assembly 20 uphole of each isolated reservoir segment, particular sensored electronic valve assemblies 20 can be maintained in an open position during certain steps of the operation and then allowed to return to the normal closed position, isolating the hydrostatic column above sensored electronic valve assembly 20 from the stimulated segment of the reservoir.

Embodiments of this disclosure therefore provides systems and methods for stimulating consecutive segments of a subterranean well, starting downhole and moving in an uphole direction, with reduced or no losses of fluids into the formation. Systems and method described in this disclosure further enhance the safety and control over fluids going in and out of the well bore, save rig time and therefore cost from milling operations and opening and closing runs, and reduces the pressures needed to open and close valves compared to currently available systems.

Embodiments of this disclosure, therefore, are well adapted to carry out the objects and attain the ends and advantages mentioned, as well as others that are inherent. While embodiments of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A system for controlling a flow of fluid within a subterranean well with a sensored electronic valve assembly, the system including:

a completion system having a tubular string extending into the subterranean well;

the sensored electronic valve assembly located within the tubular string and having:

a one way valve member operable to allow a flow of fluids in an uphole direction through the one way valve member and to prevent the flow of fluids in a downhole direction through the one way valve member;

an electronic circuit including a battery and a command center, the battery having a battery life of a predetermined time;

a sensor operable to detect a valve open signal and to deliver the valve open signal to the command center; and a battery powered opening device operable to move the one way valve member to a valve open position upon receipt of an engagement signal from the command center within the predetermined time only, the battery powered opening device being inoperable after the predetermined time; where the one way valve member is operable to function as a one way valve after the predetermined time, allowing the flow of fluids in the uphole direction through the one way valve member when the battery powered opening device is inoperable, so that the one way valve member is a fluid flow path through the tubular string for produced fluids from the subterranean well.

2. The system of claim 1, where the valve member is removable.

3. The system of claim 1, where the command center includes a data processor and a signal transmitter.

4. The system of claim 1, where the battery powered opening device is a motor.

5. The system of claim 1, where the battery powered opening device is an electromagnet.

6. The system of claim 1, where the valve open signal is a proximity of an intervention tool.

7. The system of claim 1, where the one way valve member is a normal closed valve and the sensor is further operable to detect a valve close signal and to deliver the valve close signal to the command center, and where the battery powered opening device is operable to disengage the one way valve member to allow the one way valve member to return to a normal closed position upon receipt of a disengagement signal from the command center.

8. A system for controlling a flow of fluid within a subterranean well with a sensored electronic valve assembly, the system including:

a tubular string extending into the subterranean well, the tubular string having an internal bore for transportation of fluid between an earth's surface and a downhole location within the subterranean well;

the sensored electronic valve assembly located along the tubular string, the sensored electronic valve assembly having:

a one way valve member operable to allow a flow of fluids within the tubular string in an uphole direction through the one way valve member and to prevent the flow of fluids within the tubular string in a downhole direction through the one way valve member;

a battery having a battery life of a predetermined time;

a sensor operable to detect a valve open signal; and a battery powered opening device operable to move the one way valve member to a valve open position after receipt of the valve open signal by the sensor within the predetermined time only, the battery powered opening device being inoperable after the predetermined time; where the one way valve member is operable to function as a one way valve after the predetermined time, allowing the flow of fluids in the uphole direction through the one way valve member when the battery powered opening device is inoperable, so that the one way valve member is a fluid flow path through the tubular string for produced fluids from the subterranean well.

9. The system of claim 8, further including a command center, the command center operable to receive the valve open signal detected by the sensor and to deliver an engagement signal to the battery powered opening device.

10. The system of claim 8, where the sensored electronic valve assembly further includes a valve body, the valve body housing the one way valve member and being secured in-line along the tubular string.

11. A method for controlling a flow of fluid within a subterranean well with a sensored electronic valve assembly, the method including:

extending a tubular string into the subterranean well as part of a completion system;

delivering the sensored electronic valve assembly into the subterranean well within the tubular string, the sensored electronic valve assembly having:

a one way valve member operable to allow a flow of fluids in an uphole direction through the one way valve member and to prevent the flow of fluids in a downhole direction through the one way valve member;

an electronic circuit including a battery and a command center, the battery having a battery life of a predetermined time;

a sensor; and a battery powered opening device, the battery powered opening device being inoperable after the predetermined time; where the one way valve member is operable to function as a one way valve after the predetermined time, allowing the flow of fluids in the uphole direction through the one way valve member when the battery powered opening device is inoperable so that the one way valve member is a fluid flow path through the tubular string for produced fluids from the subterranean well;

delivering a valve open signal into the subterranean well, the valve open signal being received by the sensor and being delivered to the command center by the sensor; and delivering an engagement signal from the command center to the battery powered opening device, causing the opening device to move the one way valve member to a valve open position within the predetermined time only.

12. The method of claim 11, further including removing the valve member from the subterranean well while the tubular string remains within the subterranean well.

13. The method of claim 11, where the command center includes a data processor and a signal transmitter and the method further includes processing the valve open signal with the data processor and delivering the engagement signal from the command center to the battery powered opening device with the signal transmitter.

14. The method of claim 11, where the battery powered opening device is a motor and the method further includes moving the one way valve member to the valve open position and retaining the one way valve member in the valve open position with the motor.

15. The method of claim 11, where the battery powered opening device is an electromagnet and the method further includes moving the one way valve member to the valve open position and retaining the one way valve member in the valve open position with the electromagnet.

16. The method of claim 11, where delivering the valve open signal into the subterranean well includes moving an intervention tool proximate to the sensored electronic valve assembly.

17. The method of claim 11, where the one way valve member is a normal closed valve and the method further includes detecting a valve close signal with the sensor and delivering the valve close signal to the command center, and where the battery powered opening device is operable to disengage the one way valve member to allow the one way valve member to return to a normal closed position upon receipt of a disengagement signal from the command center.

* * * * *